US010901336B2

(12) United States Patent
Yagyu et al.

(10) Patent No.: US 10,901,336 B2
(45) Date of Patent: Jan. 26, 2021

(54) POSITIVELY-CHARGEABLE TONER FOR DEVELOPING ELECTROSTATIC IMAGES AND METHOD FOR PRODUCING THE SAME

(71) Applicant: ZEON CORPORATION, Tokyo (JP)

(72) Inventors: Sakyo Yagyu, Tokyo (JP); Takeru Chiba, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/486,895

(22) PCT Filed: Feb. 28, 2018

(86) PCT No.: PCT/JP2018/007490
§ 371 (c)(1),
(2) Date: Aug. 19, 2019

(87) PCT Pub. No.: WO2018/159671
PCT Pub. Date: Sep. 7, 2018

(65) Prior Publication Data

US 2020/0233329 A1 Jul. 23, 2020

(30) Foreign Application Priority Data

Feb. 28, 2017 (JP) ..... 2017-036819

(51) Int. Cl.
*G03G 9/08* (2006.01)
*G03G 9/097* (2006.01)

(52) U.S. Cl.
CPC ..... *G03G 9/09725* (2013.01); *G03G 9/0819* (2013.01)

(58) Field of Classification Search
CPC ..... G03G 9/09725; G03G 9/0819
USPC ..... 430/108.7
See application file for complete search history.

(56) References Cited

U.S. PATENT DOCUMENTS

| | | | | |
|---|---|---|---|---|
| 5,422,214 | A | 6/1995 | Akiyama et al. | |
| 2007/0020543 | A1 | 1/2007 | Nakatani | |
| 2008/0096116 | A1* | 4/2008 | Utsumi | G03G 9/0827 430/48 |
| 2010/0330488 | A1 | 12/2010 | Ieda | |
| 2012/0237864 | A1* | 9/2012 | Saito | G03G 9/0827 430/105 |
| 2014/0295340 | A1* | 10/2014 | Iida | G03G 9/08795 430/108.3 |
| 2015/0037720 | A1* | 2/2015 | Tsuda | G03G 9/081 430/108.3 |

FOREIGN PATENT DOCUMENTS

| | | | |
|---|---|---|---|
| JP | H05-224456 | A | 9/1993 |
| JP | 2010-217919 | A | 9/2010 |
| JP | 2013-067545 | A | 4/2013 |
| JP | 2013-249215 | A | 12/2013 |
| JP | 2014-164246 | A | 9/2014 |
| WO | 2009/0044689 | A1 | 4/2009 |

OTHER PUBLICATIONS

English translation of International Preliminary Report on Patentability (Chapter I)(=PCT/IB/338) dated Sep. 12, 2019, issued in Internation application No. PCT/JP2018/007490, with English translataion.

* cited by examiner

*Primary Examiner* — Mark A Chapman
(74) *Attorney, Agent, or Firm* — Westerman, Hattori, Daniels & Adrian, LLP

(57) ABSTRACT

Provided is a positively-chargeable toner for developing electrostatic images excellent in printing durability, charge stability, and conveyance amount stability. The toner comprises colored resin particles comprising a binder resin and a colorant, and an external additive, wherein the external additive comprises spherical silica particles with a number average particle diameter of 70 to 200 nm. wherein the external additive has a particle size distribution in which a percentage of a number of particles having a particle diameter of 50 nm or more is 75% or more, which is calculated based on a SEM image.

5 Claims, No Drawings

POSITIVELY-CHARGEABLE TONER FOR DEVELOPING ELECTROSTATIC IMAGES AND METHOD FOR PRODUCING THE SAME

TECHNICAL FIELD

The present disclosure relates to a positively-chargeable toner for developing electrostatic images (hereinafter, may be simply referred to as "positively-chargeable toner" or "toner") which is used to develop an electrostatic latent image in, for example, electrophotography, electrostatic recording, and electrostatic printing.

BACKGROUND ART

Conventionally, in a toner used in a general electrophotography, a desired charging ability and fluidity are obtained by adding an external additive on surfaces of colored resin particles. As the external additive, fine particles containing an inorganic substance or an organic substance are widely and generally used. As such external additives, metal oxide particles and resin particles, and those obtained by surface-treating these have been widely used conventionally. Among them, particles of metal oxides such as silica, titania, alumina, and zinc oxide, particles of fatty acid metal salts, and those obtained by subjecting these to hydrophobizing treatment are used.

For example, Patent Literature 1 discloses a positively-chargeable toner for developing electrostatic images which comprises spherical colloidal silica fine particles having a number average primary particle diameter of from 30 nm to 80 nm and a frictional charge amount of from −50 μC/g to +300 μC/g, and further having been surface treated with cyclic silazane, for the purpose of maintaining toner characteristics such as charging ability and fluidity even when replenishing with toner.

Patent Literature 2 discloses a method for producing a toner using silica fine particles (A) having Dv50/Dv10 of 1.8 or more, a volume average particle diameter of from 0.1 μm to 1.0 μm, and a sphericity of from 1 to 1.3, for the purpose of providing a toner with less occurrence of fog and excellent cleaning performance.

CITATION LIST

Patent Literature

[Patent Literature 1] WO 2009/044689 A
[Patent Literature 2] JP 2010-217919 A

SUMMARY OF INVENTION

Technical Problem

However, the toner described in Patent Literature 1 further comprises a relatively large added amount of fumed silica fine particles, and thus still has a problem in printing durability. On the other hand, the toner described in Patent Literature 2 contains many particles having a relatively small particle diameter as a part of an external additive, and thus has a problem in printing durability.

An object of the present disclosure is to provide a positively-chargeable toner for developing electrostatic images, which is excellent in charge stability and conveyance amount stability, in addition to printing durability.

Solution to Problem

The present researchers have found that the above-mentioned problems can be solved by using spherical silica particles having a relatively large number average particle diameter and also increasing a proportion of particles having a large particle diameter in the entire external additive.

That is, a positively-chargeable toner for developing electrostatic images of the present disclosure comprises colored resin particles comprising a binder resin and a colorant, and an external additive, wherein the external additive comprises spherical silica particles;

wherein a number average particle diameter of the spherical silica particles is from 70 nm to 200 nm; and wherein the external additive has a particle size distribution in which a percentage of a number of particles having a particle diameter of 50 nm or more is 75% or more, which is calculated based on a SEM image of the external additive.

In the present disclosure, it is preferable that a content of the external additive is from 0.5 part by mass to 5.0 parts by mass with respect to 100 parts by mass of the colored resin particles.

In the present disclosure, it is preferable that the positively-chargeable toner comprises inorganic oxide particles having a number average particle diameter of from 5 nm to 25 nm, as the external additive.

In the present disclosure, it is preferable that a content of the inorganic oxide particles is from 0.01 part by mass to 0.4 part by mass with respect to 100 parts by mass of the colored resin particles.

A positively-chargeable toner for developing electrostatic images of the present disclosure comprises the steps of:

producing colored resin particles comprising a binder resin and a colorant, and external addition in which an external additive is added on surfaces of the colored resin particles by mixing and stirring the colored resin particles with the external additive, wherein, in the external addition step, an external additive which comprises spherical silica particles having a number average particle diameter of from 70 nm to 200 nm and has a particle size distribution in which a percentage of a number of particles having a particle diameter of 50 nm or more is 75% or more, which is calculated based on a SEM image of the external additive, is used.

In the production method of the present disclosure, it is preferable that the external additive comprises inorganic oxide particles having a number average particle diameter of from 5 nm to 25 nm, and the inorganic oxide particles are added on the colored resin particles, and the spherical silica particles are further added on the colored resin particles on which the inorganic oxide particles are added.

Advantageous Effects of Invention

According to the present disclosure as described above, spherical silica particles having a larger number average particle diameter than conventional ones are used, and the proportion of an external additive having a larger particle diameter than conventional ones is increased, whereby there is provided a positively-chargeable toner for developing electrostatic images, which is excellent in printing durability, charge stability, and conveyance amount stability.

Description of Embodiments

A positively-chargeable toner for developing electrostatic images of the present disclosure comprises colored resin particles comprising a binder resin and a colorant, and an external additive, wherein the external additive comprises spherical silica particles;

wherein a number average particle diameter of the spherical silica particles is from 70 nm to 200 nm; and wherein the external additive has a particle size distribution in which a percentage of a number of particles having a particle diameter of 50 nm or more is 75% or more, which is calculated based on a SEM image of the external additive.

Hereinafter, the toner of the present disclosure will be described.

The toner of the present disclosure contains colored resin particles containing a binder resin and a colorant, and an external additive.

Hereinafter, a method for producing colored resin particles used in the present disclosure, the colored resin particles obtained by the production method, a method for producing a toner using the colored resin particles, and the toner of the present disclosure will be described in this order.

1. Method for Producing Colored Resin Particles

Generally, methods for producing the colored resin particles are broadly classified into dry methods such as a pulverization method and wet methods such as an emulsion polymerization agglomeration method, a suspension polymerization method and a solution suspension method. The wet methods are preferable since toners having excellent printing characteristics such as image reproducibility can be easily obtained. Among the wet methods, polymerization methods such as the emulsion polymerization agglomeration method and the suspension polymerization method are preferable since toners which have relatively small particle size distribution in micron order can be easily obtained. Among the polymerization methods, the suspension polymerization method is more preferable.

The emulsion polymerization agglomeration method is a method for producing colored resin particles by polymerizing emulsified polymerizable monomers to obtain a resin microparticle emulsion, and aggregating the resultant resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be performed by known methods.

The colored resin particles of the present disclosure can be produced by employing the wet methods or the dry methods. The suspension polymerization method preferable among the wet methods is performed by the following processes.

(A) Suspension Polymerization Method (A-1) Preparation Process of Polymerizable Monomer Composition First, a polymerizable monomer and a colorant as well as other additives such as a charge control agent, which are added if required, are mixed to prepare a polymerizable monomer composition. For example, a media type dispersing machine is used for the mixing upon preparing the polymerizable monomer composition.

In the present disclosure, the polymerizable monomer means a monomer having a polymerizable functional group, and the polymerizable monomer is polymerizable to be a binder resin. It is preferable to use a monovinyl monomer as a main component of the polymerizable monomer.

Examples of the monovinyl monomer include styrene; styrene derivatives such as vinyltoluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitryl compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, it is preferable to use styrene, a styrene derivative, acrylic acid ester or methacrylic acid ester as a monovinyl monomer.

In order to improve the hot offset and shelf stability, it is preferable to use any crosslinkable polymerizable monomer together with the monovinyl monomer. The crosslinkable polymerizable monomer means a monomer having two or more polymerizable functional groups. Examples of the crosslinkable polymerizable monomer include: aromatic divinyl compounds such as divinyl benzene, divinyl naphthalene and derivatives thereof; ester compounds such as ethylene glycol dimethacrylate and diethylene glycol dimethacrylate, in which two or more carboxylic acids having a carbon-carbon double bond are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present disclosure, it is desirable that the amount of the crosslinkable polymerizable monomer to be used is generally from 0.1 to 5 parts by mass, preferably from 0.3 to 2 parts by mass, with respect to 100 parts by mass of the monovinyl monomer.

Further, the use of a macromonomer as a part of the polymerizable monomer achieves a good balance between the shelf stability and low-temperature fixability of the toner to be obtained, which is preferred. The macromonomer has a polymerizable carbon-carbon unsaturated double bond at the end of the molecular chain and is a reactive oligomer or polymer which usually has a number average molecular weight of 1,000 to 30,000. It is preferable that the macromonomer can form a polymer having a glass transition temperature (hereinafter sometimes referred to as "Tg") higher than that of a polymer obtained by polymerizing a monovinyl monomer.

It is desirable that the used amount of the macromonomer is preferably from 0.03 to 5 parts by mass, more preferably 0.05 to 1 parts by mass with respect to 100 parts by mass of the monovinyl monomer.

Examples of the macromonomer include poly(acrylic acid ester) macromonomer, poly(methacrylic acid ester) macromonomer, polystyrene macromonomer, polyacrylonitrile macromonomer, silicone macromonomer and copolymer of these macromonomer. Among them, poly(acrylic acid ester) macromonomer and poly(methacrylic acid ester) macromonomer are preferable to be used.

In the present disclosure, a colorant is used. To produce a color toner, a black colorant, a cyan colorant, a yellow colorant and a magenta colorant can be used.

Examples of the black colorant to be used include carbon black, titanium black and magnetic powder such as zinc-iron oxide and nickel-iron oxide.

Examples of the cyan colorant to be used include dyes and pigments such as copper phthalocyanine compounds, derivatives thereof and anthraquinone compounds. The specific examples include C. I. Pigment Blue 2, 3, 6, 15, 15:1, 15:2, 15:3, 15:4, 16, 17:1 and 60.

Examples of the yellow colorant to be used include compounds including azo pigments such as monoazo pigments and disazo pigments, condensed polycyclic pigments and dyes. The specific examples include C. I. Pigment Yellow 3, 12, 13, 14, 15, 17, 62, 65, 73, 74, 83, 93, 97, 120, 138, 155, 180, 181, 185, 186, 213 and 214.

Examples of the magenta colorant to be used include compounds including azo pigments such as monoazo pigments and disazo pigments, condensed polycyclic pigments and dyes. The specific examples include C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269 and C. I. Pigment Violet 19.

In the present disclosure, these colorants can be used alone or in combination of two or more kinds. The amount of the colorant is preferably from 1 to 10 parts by mass with respect to 100 parts by mass of the monovinyl monomer.

From the viewpoint of improving the releasing characteristics of the toner from a fixing roller during fixing, it is preferable to add the release agent to the polymerizable monomer composition. The release agent can be used without any particular limitation as long as it is generally used as a release agent for the toner.

The release agent preferably contains at least one of an ester wax or hydrocarbon wax. The use of these waxes as the release agents allows the balance between low-temperature fixability and shelf stability to be improved.

For the ester wax suitably used as the release agent in the present disclosure, Examples thereof include: monoester compounds such as stearyl stearate, behenyl behenate, behenyl stearate and stearyl behenate; pentaerythritol ester compounds such as pentaerythritol tetrapalmitate, pentaerythritol tetrabehenate, pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate and glycerin tribehenate; and dipentaerythritol ester compounds such as dipentaerythritol hexamyristate and dipentaerythritol hexapalmitate. Among them, preferred is a monoester compound.

Examples of the hydrocarbon wax suitably used as the release agent in the present disclosure include a polyethylene wax, a polypropylene wax, a Fischer-Tropsch wax, a paraffin wax, microcrystalline wax and a petroleum wax. Among them, preferred are a Fischer-Tropsch wax and a petroleum wax, more preferred is a petroleum wax.

The number average molecular weight of the hydrocarbon wax is preferably 300 to 800, more preferably 400 to 600. The penetration of the hydrocarbon wax measured in accordance with JIS K2235 5.4 is preferably 1 to 10, more preferably 2 to 7.

In addition to the release agents, natural waxes such as jojoba wax; and mineral waxes such as ozokerite can be used.

For the release agent, the wax mentioned above may be used solely or in combination of two or more kinds.

The amount of the release agent to be used is preferably 0.1 to 30 parts by mass, more preferably 1 to 20 parts by mass, with respect to 100 parts by mass of the monovinyl monomer.

In order to improve the charging ability of the toner, a charge control agent having positively charging ability or negatively charging ability can be used as another additive.

The charge control agent is not particularly limited as long as it is generally used as a charge control agent for toner. Among charge control agents, a charge control resin having positively charging ability or negatively charging ability is preferred since the charge control resin is highly compatible with the polymerizable monomer and can impart stable charging ability (charge stability) to the toner particles. From the viewpoint of obtaining a positively-chargeable toner, the charge control resin having positively charging ability is more preferably used.

Examples of the charge control agent having positively charging ability include nigrosine dyes, a quaternary ammonium salts, triaminotriphenylmethane compounds, imidazole compounds, polyamine resins as a charge control resin preferably used, quaternary ammonium group-containing copolymers, and quaternary ammonium salt group-containing copolymers.

Examples of the charge control agent having negatively charging ability include azo dyes containing metals such as Cr, Co, Al and Fe, salicylic acid metal compounds and alkyl salicylic acid metal compounds as well as charge control resins to be preferably used such as sulfonic acid group-containing copolymers, sulfonic acid salt group-containing copolymers, carboxylic acid group-containing copolymers and carboxylic acid salt group-containing copolymers.

In the present disclosure, the charge control agent is used in an amount of, generally 0.01 to 10 parts by mass, preferably 0.03 to 8 parts by mass with respect to 100 parts by mass of the monovinyl monomer. When the added amount of the charge control agent is 0.01 parts by mass or more, fog is not be likely to occur. On the other hand, when the added amount of the charge control agent is 10 parts by mass or less, printing soiling is not likely to occur.

As one of other additives, a molecular weight modifier is preferably used upon the polymerization of the polymerizable monomer which is polymerized to be a binder resin.

The molecular weight modifier is not particularly limited as long as it is generally used as a molecular weight modifier for a toner. Examples of the molecular weight modifier include: mercaptans such as t-dodecyl mercaptan, n-dodecyl mercaptan, n-octyl mercaptan and 2,2,4,6,6-pentamethylheptane-4-thiol; and thiuram disulfides such as tetramethyl thiuram disulfide, tetraethyl thiuram disulfide, tetrabutyl thiuram disulfide, N,N'-dimethyl-N,N'-diphenyl thiuram disulfide and N,N'-dioctadecyl-N,N'-diisopropyl thiuram disulfide. These molecular weight modifiers may be used solely or in combination of two or more kinds.

In the present disclosure, the molecular weight modifier is used in an amount of, generally 0.01 to 10 parts by mass, preferably 0.1 to 5 parts by mass, with respect to 100 parts by mass of the monovinyl monomer.

(A-2) Suspension Process of Obtaining Suspension (Droplets Forming Process)

In the present disclosure, the polymerizable monomer composition comprising at least a polymerizable monomer and a colorant is dispersed in an aqueous medium containing a dispersion stabilizer, and a polymerization initiator is added therein, then the droplets of the polymerizable monomer composition are formed. The method for foaming droplets is not particularly limited. The droplets are formed, for example, by means of a device capable of strong stirring such as an in-line type emulsifying and dispersing machine (product name: MILDER; manufactured by Pacific Machinery & Engineering Co., Ltd), and a high-speed emulsification dispersing machine (product name: T. K. HOMOMIXER MARK II; manufactured by PRIMIX Corporation).

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-butylperoxydiethylacetate, t-hexylperoxy-2-ethylbutanoate, diisopropylperoxydicarbonate, di-t-butylperoxyisophthalate and t-butylperoxyisobutyrate. These can be used solely or in combination of two or more kinds. Among them, the organic peroxides are preferably used since they can reduce residual polymerizable monomer and can impart excellent printing durability.

Among the organic peroxides, preferred are peroxy esters, and more preferred are non-aromatic peroxy esters, i.e. peroxy esters having no aromatic ring, since they have excellent initiator efficiency and can reduce a residual polymerizable monomer.

The polymerization initiator may be added after dispersing the polymerizable monomer composition to the aqueous medium and before forming droplets as described above, or may be added to the polymerizable monomer composition before the polymerizable monomer composition is dispersed in the aqueous medium.

The added amount of the polymerization initiator used in the polymerization of the polymerizable monomer composition is preferably 0.1 to 20 parts by mass, more preferably 0.3 to 15 parts by mass, further more preferably 1 to 10 parts by mass, with respect to 100 parts by mass of the monovinyl monomer.

In the present disclosure, the aqueous medium means a medium containing water as a main component.

In the present disclosure, the dispersion stabilizer is preferably added to the aqueous medium. Examples of the dispersion stabilizer include: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II) hydroxide; and organic compounds including water-soluble polymers such as polyvinyl alcohol, methyl cellulose and gelatin; anionic surfactants; nonionic surfactants; and ampholytic surfactants. These dispersion stabilizers can be used solely or in combination of two or more kinds.

Among the above dispersion stabilizers, colloid of inorganic compounds, particularly hardly water-soluble metal hydroxide, is preferable. The use of the colloid of inorganic compounds, particularly hardly water-soluble metal hydroxide makes it possible to narrow a particle size distribution of the colored resin particles and reduce the amount of the dispersion stabilizer remaining after washing, thus the obtained toner becomes capable of clearly reproducing images, also becomes excellent in environmental stability.

(A-3) Polymerization Process

After the droplets are famed as described in the above (A-2), thus obtained aqueous dispersion medium is heated to start polymerization. Thereby, an aqueous dispersion of colored resin particles is famed.

The polymerization temperature of the polymerizable monomer composition is preferably 50° C. or more, more preferably 60 to 95° C. The polymerization reaction time is preferably 1 to 20 hours, more preferably 2 to 15 hours.

The colored resin particle may be used as a polymerized toner by adding an external additive. It is preferable that the colored resin particle is so-called core-shell type (or "capsule type") colored resin particle which is obtained by using the colored resin particle as a core layer and foaming a shell layer, a kind of which is different from that of the core layer, around the core layer. The core-shell type colored resin particles can take a balance of lowering fixing temperature and prevention of blocking at storage, since the core layer including a substance having a low softening point is covered with a substance having a higher softening point.

A method for producing the above-mentioned core-shell type colored resin particles using the colored resin particles is not particularly limited, and can be produced by any conventional method. The in situ polymerization method and the phase separation method are preferable from the viewpoint of production efficiency.

A method for producing the core-shell type colored resin particles according to the in situ polymerization method will be hereinafter described.

A polymerizable monomer for foaming a shell layer (a polymerizable monomer for shell) and a polymerization initiator are added to an aqueous medium to which the colored resin particles are dispersed, followed by polymerization, thus the core-shell type colored resin particles can be obtained.

As the polymerizable monomer for shell, the above-mentioned polymerizable monomer can be similarly used. Among the polymerizable monomers, any of monomers which provide a polymer having Tg of more than 80° C. such as styrene, acrylonitrile and methyl methacrylate is preferably used solely or in combination of two or more kinds.

Examples of the polymerization initiator used for polymerization of the polymerizable monomer for shell include: water-soluble polymerization initiators including metal persulfates such as potassium persulfate and ammonium persulfate; and azo-type initiators such as 2,2'-azobis(2-methyl-N-(2-hydroxyethyl)propionamide) and 2,2'-azobis(2-methyl-N-(1,1-bis(hydroxymethyl)-2-hydroxyethyl) propionamide). These polymerization initiators can be used solely or in combination of two or more kinds. The amount of the polymerization initiator is preferably 0.1 to 30 parts by mass, more preferably 1 to 20 parts by mass, with respect to 100 parts by mass of the polymerizable monomer for shell.

The polymerization temperature of the shell layer is preferably 50° C. or more, more preferably 60 to 95° C. The polymerization reaction time is preferably 1 to 20 hours, more preferably 2 to 15 hours.

(A-4) Processes of Washing, Filtering, Dehydrating and Drying

It is preferable that the aqueous dispersion of the colored resin particles obtained by the polymerization is subjected to operations including filtering, washing for removing the dispersion stabilizer, dehydrating, and drying by several times as needed after the polymerization, according to any conventional method.

In the washing method, when the inorganic compound is used as the dispersion stabilizer, it is preferable that acid or alkali is added to the aqueous dispersion of colored resin particles; thereby, the dispersion stabilizer is dissolved in water and removed when colloid of hardly water-soluble inorganic hydroxide is used as the dispersion stabilizer, it is preferable to control pH of the aqueous dispersion of colored resin particles to 6.5 or less. Examples of the acid to be added include inorganic acids such as sulfuric acid, hydrochloric acid and nitric acid, and organic acids such as formic acid and acetic acid. Particularly, sulfuric acid is suitable for high removal efficiency and small impact on production facilities.

The methods for dehydrating and filtering are not particularly limited, and any of various known methods can be used. For example, a centrifugal filtration method, a vacuum filtration method and a pressure filtration method can be used. Also, the drying method is not particularly limited, and any of various methods can be used.

(B) Pulverization Method

In the case of producing the colored resin particles by employing the pulverization method, the following processes are performed.

First, a binder resin, a colorant, and other additives such as a charge control agent etc., which are added if required, are mixed by means of a mixer such as a ball mill, a V type mixer, HENSCHEL MIXER (product name), a high-speed dissolver or an internal mixer. Next, the above-obtained mixture is kneaded while heating by means of a press kneader, a twin screw kneading machine or a roller.

The obtained kneaded product is coarsely pulverized by means of a pulverizer such as a hammer mill, a cutter mill or a roller mill, followed by finely pulverizing by means of a pulverizer such as a jet mill or a high-speed rotary pulverizer, and classifying into desired particle diameters by means of a classifier such as an air classifier or an airflow classifier. Thus, colored resin particles produced by the pulverization method can be obtained.

Incidentally, the binder resin, the colorant and other additives such as the charge control agent etc., which are added if required, used in "(A) Suspension polymerization method" can be used in the pulverization method. Similarly as the colored resin particles obtained by "(A) Suspension polymerization method", the colored resin particles obtained by the pulverization method can also be in a form of the core-shell type colored resin particles produced by a method such as the in situ polymerization method.

As the binder resin, other resins which are conventionally and broadly used for toners can be used. Specific examples of the binder resin used in the pulverization method include polystyrene, styrene-butyl acrylate copolymers, polyester resins and epoxy resins.

2. Colored Resin Particles

The colored resin particles are obtained by the above production method such as (A) Suspension polymerization method or (B) Pulverization method.

Hereinafter, the colored resin particles constituting the toner will be described. The colored resin particles hereinafter include both core-shell type colored resin particles and colored resin particles which are not core-shell type.

The volume average particle diameter (Dv) of the colored resin particles is preferably 4 to 12 μm, more preferably 5 to 10 μm, further more preferably 6 to 9 μm, and still further more preferably 6.5 to 8.0 μm. when the volume average particle diameter (Dv) of the colored resin particles is 4 μm or more, the toner has a high flowability, thereby making it possible to maintain an excellent transferability and keep a high image density. when the volume average particle diameter (Dv) of the colored resin particles is 12 μm or less, the toner can maintain a high resolution of images.

As for the colored resin particles, a ratio (Dv/Dn) of the volume average particle diameter (Dv) and the number average particle diameter (Dn) is preferably 1.0 to 1.3, more preferably 1.0 to 1.2. when "Dv/Dn" is 1.3 or less, the toner can keep all the transferability, image density and resolution high. The volume average particle diameter and the number average particle diameter of the colored resin particles can be measured, for example, by means of a particle diameter measuring device (product name: MULTISIZER; manufactured by Beckman Coulter, Inc.), etc.

The average circularity of the colored resin particles in the present disclosure is in a range of, preferably 0.96 to 1.00, more preferably 0.97 to 1.00, and still more preferably 0.98 to 1.00 from the viewpoint of the image reproducibility.

when the average circularity is 0.96 or more, the thin line reproducibility in printing is not likely to deteriorate.

In the present disclosure, "circularity" is defined as a value obtained by dividing the perimeter of a circle having the same area as the projected area of a particle image by the perimeter of the projected image of the particle. Also in the present disclosure, "average circularity" is used as a simple method for quantitatively representing the shape of the particles and is the indicator of the degree of the surface roughness of the colored resin particles. The average circularity is 1 when the colored resin particles is perfectly spherical, and it gets smaller as the surface shape of the colored resin particles becomes more complex.

3. Method for Producing a Toner

In the present disclosure, the external addition is conducted by mixing and stirring the colored resin particles described above together with an external additive, thereby the external additive are added on surfaces of the colored resin particles to form an one-component toner (the developer). The one-component toner may be mixed and stirred together with carrier particles to form a two-component toner.

The number average particle diameter of the spherical silica particles used as the external additive is from 70 nm to 200 nm, preferably from 75 nm to 150 nm, and further preferably from 80 nm to 120 nm.

When the number average particle diameter of the spherical silica particles is 70 nm or more, defects such as aggregation of the spherical silica particles and burying of the spherical silica particles to colored resin particles are also small, and a possibility of causing adverse effects on printing performance of the toner is also small. On the other hand, when the number average particle diameter of the spherical silica particles is 200 nm or less, the spherical silica particles are hardly liberated (detached) from the colored resin particles, and it is possible to sufficiently impart desired functions (functions such as charge stability and fluidity) as the external additive to toner particles, and the possibility of causing adverse effects on printing performance of the toner is also small.

The sphericity of the spherical silica particles is usually from 1 to 1.3, preferably from 1 to 1.25, more preferably from 1 to 1.20, and further preferably from 1 to 1.18.

When the sphericity of the spherical silica particles is 1.3 or less, the toner has a good charge rising property, and can keep a charge amount distribution narrow, can suppress an initial fog, is excellent in initial printing performance, can sufficiently impart a stable charging ability and fluidity to the toner particles over time, can maintain thin line reproducibility in continuous printing of a large number of sheets, also causes less image quality deterioration due to, for example, fog, and is excellent in durable printing performance. These tendencies are the same even under severe environments such as low temperature and low humidity and high temperature and high humidity.

Here, the term "sphericity" is defined as a value obtained by dividing an area (Sc) of a circle with a diameter being the same as an absolute maximum length of a particle by a real projected area (Sr) of the particle.

The sphericity (Sc/Sr) of the spherical silica particles is a value obtained by analyzing Sc and Sr in the photograph of the spherical silica particles taken by an electron microscope with an image processing analyzer, calculating and arithmetically averaging the sphericity (Sc/Sr).

The method for producing the spherical silica particles is not particularly limited as long as silica particles having high sphericity are generally obtained. For example, a method such as a sol-gel method, a deflagration method, a wet method, or a melting method can be adopted. Among these methods, since spherical silica particles meeting the requirements of the external additive are easily obtained, a melting method and a wet method are preferable, and a wet method is more preferable. Also, the spherical silica particles are preferably colloidal silica particles obtained by a wet method.

As the spherical silica particles, those that have been subjected to hydrophobizing treatment with a hydrophobizing agent are preferably used, from the viewpoint of enhancing an effect of attaching and adding (externally adding) suitably on surfaces of the colored resin particles. As the hydrophobizing agent, for example, a silane coupling agent, and silicone oil can be used.

Examples of the silane coupling agent include disilazanes such as hexamethyldisilazane; cyclic silazanes; alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane and vinyltriacetoxysilane; and aminosilane compounds such as γ-aminopropyltriethoxysilane, γ-(2-aminoethyl)aminopropyltrimethoxysilane, γ-(2-aminoethyl)aminopropylmethyldimethoxysilane, N-phenyl-3-aminopropyltrimethoxysilane, N-(2-aminoethyl)3-aminopropyltrimethoxysilane and N-β-(N-vinylbenzylaminoethyl)-γ-aminopropyltrimethoxysilane.

Examples of the silicone oil include dimethylpolysiloxane, methylhydrogenpolysiloxane, methylphenylpolysiloxane, and amino-modified silicone oil.

These hydrophobizing agents may be used solely or in combination of two or more kinds. In addition, the amount of the hydrophobizing agent used is preferably from 1 parts by mass to 50 parts by mass, more preferably from 5 parts by mass to 40 parts by mass, and further preferably from 10 parts by mass to 30 parts by mass, with respect to 100 parts by mass of the spherical silica particles.

The method for hydrophobizing spherical silica particles is not particularly limited as long as it is a general method for hydrophobizing silica particles, and, for example, a method such as a dry method or a wet method can be adopted.

Specifically, examples of the dry method include a method of dropping or spraying a hydrophobizing agent while stirring spherical silica particles at high speed, and examples of the wet method include a method of dissolving a hydrophobizing agent in an organic solvent and adding spherical silica particles while stirring the organic solvent.

The content of the spherical silica particles is preferably from 0.5 part by mass to 4.5 parts by mass, more preferably from 1.0 parts by mass to 4.0 parts by mass, and further preferably from 1.5 parts by mass to 3.5 parts by mass, with respect to 100 parts by mass of the colored resin particles.

When the content of the spherical silica particles is 0.5 part by mass or more, desired functions (functions such as charge stability and fluidity) as the external additive are obtained, and the toner is excellent in printing performance. On the other hand, when the content of the spherical silica particles is 4.5 parts by mass or less, the toner has a good charge rising property, and further, since the spherical silica particles are hardly liberated (detached) from the colored resin particles, it is possible to impart a stable charging ability and fluidity to the toner particles over time, and the possibility of causing adverse effects on printing performance of the toner is also small.

As the spherical silica particles, those prepared in advance may be used or a commercially available product may be adopted.

As the spherical silica particles, various commercially available products can be used, and examples include UFP-30H (: product name, number average particle diameter: 110 nm, sphericity: 1.13) manufactured by Denki Kagaku Kogyo K. K.; and X-24-9163A (: product name, number average particle diameter: 140 nm, sphericity: 1.12) manufactured by Shin-Etsu Chemical Co., Ltd., and KMPX100 (: product name, number average particle diameter: 100 nm, sphericity: 1.12).

It is preferable that inorganic oxide particles having a number average particle diameter of from 5 nm to 25 nm are further contained as the external additive.

When the number average particle diameter of the inorganic oxide particles is 5 nm or more, defects such as aggregation of the inorganic oxide particles and burying of the inorganic oxide particles to the colored resin particles are also small, and the possibility of causing adverse effects on printing performance of the toner is also small. On the other hand, when the number average particle diameter of the inorganic oxide particles is 25 nm or less, the inorganic oxide particles are hardly liberated (detached) from the colored resin particles, and it is possible to sufficiently impart desired functions (functions such as charge stability and fluidity) as the external additive to the toner particles, and the possibility of causing adverse effects on printing performance of the toner is also small.

The number average particle diameter of the inorganic oxide particles is more preferably from 7 nm to 20 nm.

As the inorganic oxide particles, those that have been subjected to hydrophobizing treatment with a hydrophobizing agent are preferably used, from the viewpoint of enhancing an effect of attaching and adding (externally adding) suitably on the surfaces of the colored resin particles. As the hydrophobizing agent, the same hydrophobizing agent as in the case of the spherical silica particles can be used.

In the present disclosure, the content of the inorganic oxide particles is preferably from 0.01 part by mass to 0.6 part by mass, more preferably from 0.05 part by mass to 0.4 part by mass, and further preferably from 0.1 part by mass to 0.2 part by mass, with respect to 100 parts by mass of the colored resin particles.

In the present disclosure, when the content of the inorganic oxide particles is 0.01 part by mass or more, the desired functions (functions such as charge stability and fluidity) as the external additive are obtained, and the possibility of causing adverse effects on printing performance of the toner is also small. On the other hand, when the content of the inorganic oxide particles is 0.6 part by mass or less, the toner has a good charge rising property, and further, it is possible to impart a stable charging ability and fluidity to the toner particles over time, and the possibility of causing adverse effects on printing performance of the toner is also small.

Examples of the inorganic oxide particles include silica, titanium oxide, aluminum oxide, zinc oxide, tin oxide, and cerium oxide. The inorganic oxide particles preferably contain at least one of silica and titanium oxide, and more preferably contain silica. The inorganic oxide particles are further preferably fumed silica particles obtained by a dry method.

As the inorganic oxide particles, those prepared in advance may be used, or commercially available products may be adopted.

As the inorganic oxide particles, various commercially available silica particles can be used, and examples include HDK2150 (: product name, number average particle diameter: 12 nm) manufactured by Clariant; R504 (: product name, number average particle diameter: 12 nm) and RA200HS (: product name, number average particle diameter: 12 nm) manufactured by Nippon Aerosil Co., Ltd.; MSP-013 (: product name, number average particle diameter: 12 nm) manufactured by Tayca Corporation; and TG-820F (: product name, number average particle diameter: 7 nm) and TG-7120F (: product name, number average particle diameter: 22 nm) manufactured by Cabot Corporation.

In the present disclosure, the external additive has a particle size distribution in which a percentage of a number of particles having a particle diameter of 50 nm or more is 75% or more, preferably 80% or more, and more preferably 85% or more, which is calculated based on a SEM image of the external additive. When the percentage of the number of particles having a particle diameter of 50 nm or more in the particle size distribution is 75% or more, the toner has a high flowability and thereby posses excellent conveyance amount stability and charge stability.

The upper limit of the percentage of the number of particles having a particle diameter of 50 nm or more in the particle size distribution is not particularly limited, and may be, for example, 100% or less.

The calculation method of the particle size distribution of the external additive and the calculation method of the percentage of the number of particles having a particle diameter of 50 nm or more are as follows. First, a surface of the toner particles after external addition is observed by SEM, and ten or more SEM images are taken. Then, an image processing and an image analysis is performed on the SEM images, and the size (particle diameter) of the external additive present on the toner particle surface and the number frequency of each size are calculated, thereby obtaining the particle size distribution of the external additive. From this particle size distribution, the percentage of the number of particles having a particle diameter of 50 nm or more is calculated.

The content of the external additive is preferably from 0.5 part by mass to 5.0 parts by mass, more preferably from 0.6 part by mass to 4.5 parts by mass, and further preferably from 0.8 part by mass to 4.0 parts by mass, with respect to 100 parts by mass of the colored resin particles.

When the content of the external additive is 0.5 part by mass or more, desired functions (functions such as charge stability and fluidity) as the external additive are obtained, and the toner is excellent in printing performance. On the other hand, when the content of the external additive is 5.0 parts by mass or less, the toner has a good charge rising property, and further, since the external additive is hardly liberated (detached) from the colored resin particles, it is possible to impart a stable charging ability and fluidity to the toner particles over time, and the possibility of causing adverse effects on printing performance of the toner is also small.

The mixer for performing the external addition is not particularly limited as long as it is a mixer capable of add the external additive on the surface of the colored resin particles. For example, the external addition can be performed by means of a mixing machine capable of mixing and stirring, such as HENSCHEL MIXER (: product name, manufactured by Mitsui Mining Co., Ltd), FM Mixer (: product name, manufactured by NIPPON COKE & ENGINEERING CO., LTD.), SUPER MIXER (: product name, manufactured by KAWATA Manufacturing Co., Ltd.), Q MIXER (: product name, manufactured by NIPPON COKE & ENGINEERING CO., LTD.), MECHANOFUSION SYSTEM (: product name, manufactured by Hosokawa Micron Corporation) and MECHANOMILL (: product name, manufactured by Okada Seiko Co., Ltd.).

Incidentally, the number average particle diameter of the external additive particles used in the present disclosure can be measured, for example, as follows. First, the particle diameter of each particle of the external additive is measured by, for example, a transmission electron microscope (TEM). Thus, the particle diameter of 200 or more external additive particles is measured, and the average value thereof is taken as the number average particle diameter of the particles.

When two or more types of external additives are used in combination in an external addition, the order of the external additives added to the colored resin particles is not particularly limited. For example, in the case of using the spherical silica particles and the inorganic oxide particles in combination, all external additives may be added to the colored resin particles at one time, the spherical silica particles may be added after the inorganic oxide particles are added on the colored resin particles, or the inorganic oxide particles may be added after the spherical silica particles are added on the colored resin particles.

When two or more types of external additives are used in combination, it is preferable to add external additives in order from an external additive having a smaller number average particle diameter. For example, in the case of using the spherical silica particles and the inorganic oxide particles in combination, it is preferable that the inorganic oxide particles are added on the colored resin particles, and the spherical silica particles are further added on the colored resin particles on which the inorganic oxide particles have been added. This is because, unless the inorganic oxide particles and the spherical silica particles are added at the same time, a possibility that the inorganic oxide particles are added on surfaces of the spherical silica particles is also small, and an effect of using these two types of external additives in combination can be fully exhibited. In order to add the external additive on the toner surface uniformly, it is preferable to add the inorganic oxide particles and the spherical silica particles in this order.

4. Toner of the Present Disclosure

The toner of the present disclosure uses spherical silica particles having a larger number average particle diameter than conventional ones and uses less external additive particles having a small particle diameter than conventional ones, whereby the rate of an external additive buried in the toner particle surface is reduced. As a result, the toner of the present disclosure is excellent in charge stability and conveyance amount stability.

The team "conveyance amount stability" as used herein refers to toner characteristics in which the amount of the toner conveyed from a development device (conveyance amount) is stable over time. Usually, when printing is performed on a large number of sheets, the toner is physically stressed in a development device and the external additive is buried, thereby an attachment between toner particles is increased, fluidity is lowered, and the conveyance amount of toner tends to be unstable. The conveyance amount of toner usually increases with the change in the toner characteristics with time.

An example of the method of measuring the conveyance amount is as follows. First, after leaving the toner for 24 hours in a normal temperature and normal humidity (N/N) environment (for example, temperature: 23° C., humidity: 50%), in the same environment, 20,000 sheets were continuously printed at a printing density of 5%. At this time, for every 500 sheets, the toner suction amount is measured for a toner mounted on a developing roll by a suction-type actual machine charge amount measurement device. The toner suction amount is regarded as the conveyance amount of the toner, and is used for calculation of conveyance amount stability as follows.

The conveyance amount stability is represented by a value obtained by dividing a conveyance amount after durable printing by a standard conveyance amount, as shown in the following calculation formula 1. Here, the standard conveyance amount (M1) is a conveyance amount used as a stability criterion, and mainly refers to a conveyance amount at the start of continuous printing. Further, the conveyance amount after durable printing (M2) refers to a conveyance amount after completion of printing of a large number of sheets.

conveyance amount stability=conveyance amount after durable printing (M2)/standard conveyance amount (M1) Calculation formula 1:

As the value of conveyance amount stability is close to 1, the conveyance amount is not changed even after printing of a large number of sheets, which indicates that toner characteristics are stable over time. On the other hand, a larger value of conveyance amount stability indicates that the conveyance amount of toner increases too much after printing of a large number of sheets, and indicates that toner characteristics are instable over time. Thus, the conveyance amount stability is one of the indicators of changes in the toner characteristics with time.

EXAMPLES

Hereinafter, the present disclosure will be described further in detail with reference to examples and comparative examples. However, the present disclosure is not limited to these examples. Herein, parts and % are based on mass unless otherwise noted.

Test methods performed in the examples and the comparative examples are as follows.

1. Preparation of Spherical Silica Particles

Production Example 1

In a 3 L glass reactor equipped with a stirrer, a dropping funnel and a thermometer, 623.7 g of methanol, 41.4 g of water, and 49.8 g of 28% aqueous ammonia were added and mixed, and the temperature of the mixed solution was adjusted to be 35° C.

While stirring the mixed solution in which the temperature was adjusted, dropwise addition of 1250 g of a mixture of tetramethoxysilane and tetrabutoxysilane and dropwise addition of 418.1 g of 5.4% aqueous ammonia were started at the same time. Here, 1250 g of the mixture of tetramethoxysilane and tetrabutoxysilane was added dropwise over 8.5 hours, and the 5.4% aqueous ammonia was added dropwise over 5 hours, respectively.

Even after finishing the dropping, the hydrolysis was performed by further continuing the stir of the mixed solution for 0.5 hour to obtain a suspension of spherical silica particles.

Subsequently, an ester adapter and a condenser tube were mounted on the 3 L glass reactor, and the obtained suspension of spherical silica particles was heated up to a temperature of 60° C. to 70° C. to distill off (distill and remove) methanol. Then, water was added thereto, and the suspension was heated up to a temperature of 70° C. to 90° C. to completely distill off (distill and remove) methanol, thereby obtaining an aqueous suspension of spherical silica particles.

While stirring the obtained aqueous suspension of spherical silica particles, dropwise addition of methyltrimethoxysilane was started at room temperature and 11.6 g of methyltrimethoxysilane was added dropwise over 0.5 hours. Even after finishing the dropping, hydrophobizing treatment was performed by further continuing the stir of the aqueous suspension for 12 hours.

To the hydrophobized aqueous suspension, 1440 g of methyl isobutyl ketone was added, thereafter, the aqueous suspension was heated up to a temperature of 80° C. to 110° C. to distill off (distill and remove) an azeotropic mixture over 10 hours, and then the aqueous suspension was cooled to room temperature.

After 1000 g of methanol was added to the cooled aqueous suspension and the mixture was stirred for 10 minutes, the mixture was processed with a centrifuge at 3000 G for 10 minutes to separate a supernatant liquid. After distilling off the solvents, methyl isobutyl ketone and methanol, from the residual liquid, the obtained matter was dried to obtain spherical silica particles.

To 100 g of the dried spherical silica particles, 10 g of hexamethyldisilazane and 10 g of a compound represented by the following formula 1 as a cyclic silazane were added as hydrophobizing agents at room temperature, and then the mixture was heated up to 110° C. and reacted for hours, whereby the spherical silica particles were hydrophobized.

Subsequently, the mixture was heated up to 80° C. under reduced pressure (6650 Pa) to completely distill off (distill and remove) the solvent to prepare spherical silica particles (silica a, number average particle diameter: 90 nm, sphericity: 1.12).

[Chemical formula 1]

Formula 1

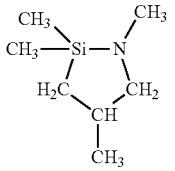

Production Example 2 to Production Example 6

Spherical silica particles (silica b to silica f) of Production Example 2 to Production Example 6 were prepared similarly as in Production Example 1 except that, in Production Example 1, the dropping amount and dropping time of the mixture of tetramethoxysilane and tetrabutoxysilane were changed as shown in Table 1 below, and subjected to the tests.

Preparation conditions of the silica in Production Examples 1 to 6 and physical properties of the each silica thus produced are shown in Table 1 below. The "dropping amount" and "dropping time" in Table 1 below mean a dropping amount and dropping time of the mixture of tetramethoxysilane and tetrabutoxysilane.

TABLE 1

| | | Production Example 1 Silica a | Production Example 2 Silica b | Production Example 3 Silica c | Production Example 4 Silica d | Production Example 5 Silica e | Production Example 6 Silica f |
|---|---|---|---|---|---|---|---|
| Preparation condition | Dropping amount (g) | 1250 | 1250 | 1250 | 1700 | 1500 | 1300 |
| | Dropping time (h) | 8.5 | 7.0 | 8.0 | 4.0 | 5.0 | 6.0 |
| Property | Number average particle diameter (nm) | 90 | 80 | 85 | 30 | 50 | 70 |
| | Sphericity | 1.12 | 1.11 | 1.12 | 1.13 | 1.15 | 1.13 |

2. Production of Positively-Chargeable Toner for Developing Electrostatic Images Example 1

78 parts of styrene and 22 parts of n-butyl acrylate as polymerizable monomers, and 5 parts of carbon black (manufactured by Mitsubishi Chemical Corporation, product name: #25BS) as a black colorant were dispersed using an in-line type emulsifying and dispersing machine (manufactured by Pacific Machinery & Engineering Co., Ltd., product name: MILDER) to obtain a polymerizable monomer mixture.

To the polymerizable monomer mixture, 1.0 parts of a charge control resin (quaternary ammonium group-containing styrene acrylic resin) as a charge control agent, 5.0 parts of a fatty acid ester wax (behenyl behenate) as a release agent, 0.3 part of a polymethacrylic acid ester macromonomer (manufactured by TOAGOSEI CO., LTD., product name: AA6) as a macromonomer, 0.6 part of divinylbenzene as a crosslinkable polymerizable monomer, and 1.6 parts of t-dodecyl mercaptan as a molecular weight modifier were added, then mixed and dissolved to prepare a polymerizable monomer composition.

On the other hand, an aqueous solution containing 7.2 parts of sodium hydroxide (alkali metal hydroxide) dissolved in 50 parts of ion-exchanged water was gradually added to an aqueous solution containing 12.2 parts of magnesium chloride (water-soluble polyvalent metal salt) dissolved in 250 parts of ion-exchanged water at room temperature while stirring to prepare a magnesium hydroxide colloid (hardly water-soluble metal hydroxide colloid) dispersion.

The polymerizable monomer composition was charged into the magnesium hydroxide colloid dispersion at room temperature and stirred. After charging 4.4 parts of t-butylperoxydiethyl acetate as a polymerization initiator thereinto, the mixture was subjected to a high shear stirring at 15,000 rpm for 10 minutes and dispersed, using an in-line type emulsifying and dispersing machine (manufactured by Pacific Machinery & Engineering Co., Ltd., product name: MILDER), to form droplets of the polymerizable monomer composition.

The suspension in which the droplets of the polymerizable monomer composition were dispersed (polymerizable monomer composition dispersion) was charged into a reactor furnished with a stirring blade and the temperature thereof was raised to 90° C. to start a polymerization reaction. When the polymerization conversion reached almost 100%, 1 parts of methyl methacrylate as a polymerizable monomer for shell and 0.3 part of 2,2'-azobis(2-methyl-N-(2-hydroxyethyl)-propionamide) (manufactured by Wako Pure Chemical Industries, Ltd., product name: VA-086, water-soluble) dissolved in 10 parts of ion-exchanged water were added. After continuing a reaction at 90° C. for 4 hours, the reactor was cooled by water to stop the reaction to obtain an aqueous dispersion of colored resin particles having a core-shell type structure.

The aqueous dispersion of colored resin particles was subjected to acid washing, in which sulfuric acid was added dropwise to be pH of 6.5 or less while stirring at room temperature. Subsequently, filtration separation was performed, and 500 parts of ion-exchanged water was added to the obtained solid content to make a slurry again, then a water washing treatment (washing, filtration and dehydration) was repeatedly performed several times. Next, filtration separation was performed, and the obtained solid content was placed in a container of a dryer and dried at 45° C. for 48 hours to obtain dried colored resin particles. The obtained colored resin particles had a volume average particle diameter (Dv) of 7.5 μm, a number average particle diameter (Dn) of 6.6 μm, a particle size distribution (Dv/Dn) of 1.14, and an average degree of circularity of 0.987.

To 100 parts of the above-obtained colored resin particles, 0.1 part of positively-chargeable silica particles having a number average particle diameter of 7 nm (manufactured by Cabot, product name: TG820F), the surfaces of which had been hydrophobized by hexamethyldisilazane and a cyclic silazane as hydrophobizing agents was added, and an external addition treatment was performed by mixing and stirring at a circumferential speed of 40 m/s for 10 minutes, using a high speed stirrer (manufactured by NIPPON COKE & ENGINEERING. CO., LTD., product name: FM MIXER). Thereafter, 3.6 parts of silica a (number average particle diameter: 90 nm, sphericity: 1.12) as spherical silica particles was added to the obtained mixture, and an external addition treatment was performed by mixing and stirring at a circumferential speed of 40 m/s for 10 minutes, using a high speed stirrer to obtain a toner of Example 1. The test results are shown in Table 1.

Example 2 to Example 9 and Comparative Example 1 to Comparative Example 4

Toners of Example 2 to Example 9 and Comparative example 1 to Comparative example 4 were prepared similarly as in Example 1 except that, in the external addition treatment of Example 1, the type and content of the spherical silica particles and the content of the inorganic oxide particles were changed as shown in Table 2 below, and subjected to the tests.

3. Evaluation of Spherical Silica Particles (1) Measurement of Number Average Particle Diameter The number average particle diameter of the silica a to silica f was measured by the following method.

First, scanning electron micrographs of each spherical silica particle were taken, and diameters of the equivalent circles corresponding to projected areas of the particles in the micrographs were calculated under conditions of an area ratio of particles to a frame area of up to 2% and a total number of processed particles of 100, by an image processing analyzer (manufactured by NIRECO CORPORATION, product name: LUZEX IID). The arithmetic mean value thereof was taken as the number average particle diameter of the spherical silica particles.

(2) Measurement of Sphericity

The sphericity of the silica a to silica f was measured by the following method.

First, scanning electron micrographs of each spherical silica particle were taken. Using the same image processing analyzer and under the same analysis conditions as in the measurement of the number average particle diameter, the area (Sc) of a circle with a diameter being the same as an absolute maximum length of a particle and the real projected area (Sr) of the particle in the micrographs were analyzed. The sphericity (Sc/Sr) was calculated from these analytical values, and the arithmetic mean value thereof was taken as the sphericity of the spherical silica particles.

4. Calculation of Particle Size Distribution of External Additive

The particle size distribution of the external additive used for each of the toners of Example 1 to Example 9 and Comparative example 1 to Comparative example 4 was calculated by the following method.

First, a surface of the toner particles after external addition was observed using a scanning electron microscope (SEM) (manufactured by JEOL Ltd., model number: JSM-7610F), and 20 SEM images were taken at a magnification of 45,000 times. The particle size distribution of the external additive was obtained by performing image processing and image analysis on the SEM images and calculating the size (particle diameter) of the external additive present on the toner particle surface and the number frequency of each size. From this particle size distribution, a percentage of a number of particles having a particle diameter of 50 nm or more was calculated.

5. Evaluation of Positively-Chargeable Toner for Developing Electrostatic Images Evaluation of toner was carried out for each of the toners of Example 1 to Example 9 and Comparative example 1 to Comparative example 4. Details are as follows.

(1) Printing Durability Test

In this test, using a commercially-available, non-magnetic one-component development printer (printing speed: 40 sheets of A4 size/min), the toner was charged into a toner cartridge of a development device, and then printing sheets were set.

After being left in a normal temperature and normal humidity (N/N) environment (temperature: 23° C., humidity: 50%) for 24 hours, in the same environment, 20,000 sheets were continuously printed at a printing density of 5%.

Black solid pattern printing (100% printing density) was performed at every 500th sheet, and the printing density of the black solid pattern printed image was measured using a reflection densitometer (manufactured by Macbeth, product name: RD918). Further, thereafter, white solid pattern (0% printing density) was printed, and the printer was stopped in the middle of the white solid pattern-printing, then the toner in a non-image area on a photoconductor after development was attached to an adhesive tape (manufactured by Sumitomo 3M Limited, product name: SCOTCH MENDING TAPE 810-3-18). Then, the tape was removed therefrom and attached to a printing sheet.

Next, a whiteness degree (B) of the printing sheet, on which the adhesive tape had been attached, was measured by means of a whiteness meter (manufactured by Nippon Denshoku Industries Co., Ltd., product name: ND-1). Similarly, only an unused adhesive tape was attached on the printing sheet, and a whiteness degree (A) thereof was measured. Then, a difference (B−A) between these whiteness degrees was taken as a fog value (%). The smaller value indicates that fog is less, and image quality is better.

The number of continuously printed sheets that could maintain an image quality at a printing density of 1.3% or more and a fog value of 3% or less was examined.

Incidentally, in Table 2 below, ">20000" indicates that the image quality at a printing density of 1.3% or more and a fog value of 3% or less could be maintained even at the time of 20,000 sheets.

(2) Charge Stability and Conveyance Amount Stability Tests

The same printer as in the printing durability test was used, then the toner was filled and the printing sheets were set therein.

After being left in a normal temperature and normal humidity (N/N) environment (temperature: 23° C., humidity: 50%) for 24 hours, in the same environment, 20,000 sheets were continuously printed at a printing density of 5%.

At every 500th sheet, the charge amount and the toner suction amount were measured for a toner mounted on a developing roll by a suction-type actual machine charge amount measurement device.

A value (Q2/Q1) obtained by dividing the toner charge amount (Q2) at the time of printing of 20,000 sheets by the toner charge amount (Q1) at the start of continuous printing was used as an index of charge stability. As this indicator (Q2/Q1) is close to 1, it means that a fluctuation of the toner charge amount is smaller, which means that the toner is excellent in charge stability.

The toner suction amount was regarded as the conveyance amount of the toner. A value (M2/M1) obtained by dividing the conveyance amount of toner (M2) at the time of printing of 20,000 sheets by the conveyance amount of toner (M1) at the start of measurement was used as an index of the conveyance amount stability. As this indicator (M2/M1) is close to 1, it means that a fluctuation of the toner conveyance amount is smaller, which means that the toner is excellent in conveyance amount stability.

The measurement and evaluation results of the toners of Example 1 to Example 9 and Comparative example 1 to Comparative example 4 are shown in Table 2 below together with the information of the external additive.

TABLE 2

| | Example 1 | Example 2 | Example 3 | Example 4 | Example 5 | Example 6 | Example 7 |
|---|---|---|---|---|---|---|---|
| Type of Spherical silica particles | Silica a | Silica b | Silica c | Silica c | Silica c | Silica c | Silica a |
| Number average particle diameter (nm) | 90 | 80 | 85 | 85 | 85 | 85 | 90 |
| Sphericity | 1.12 | 1.11 | 1.12 | 1.12 | 1.12 | 1.12 | 1.12 |
| Content (parts) | 3.6 | 2.4 | 0.70 | 2.0 | 2.7 | 1.2 | 3.6 |
| Content of Inorganic oxide particles (parts) | 0.1 | 0.1 | 0.1 | 0.1 | 0.1 | 0.1 | 0 |
| Whole content of External additive (parts) | 3.7 | 2.5 | 0.8 | 2.1 | 2.8 | 1.3 | 3.6 |
| Percentage of a number of particles having a particle diameter of 50 nm or more in External additive (%) | 89 | 85 | 80 | 87 | 88 | 84 | 91 |
| Printing durability (sheets) | >20000 | >20000 | >20000 | >20000 | >20000 | >20000 | 20000 |
| Charge stability (Q2/Q1) | 0.73 | 0.99 | 0.86 | 0.72 | 0.74 | 0.85 | 0.72 |
| Conveyance amount stability (M2/M1) | 0.95 | 1.07 | 1.58 | 1.45 | 1.03 | 1.35 | 1.04 |

| | Example 8 | Example 9 | Comparative Example 1 | Comparative Example 2 | Comparative Example 3 | Comparative Example 4 |
|---|---|---|---|---|---|---|
| Type of Spherical silica particles | Silica b | Silica c | Silica d | Silica e | Silica f | Silica f |
| Number average particle diameter (nm) | 80 | 85 | 30 | 50 | 70 | 70 |
| Sphericity | 1.11 | 1.12 | 1.13 | 1.15 | 1.13 | 1.13 |
| Content (parts) | 2.4 | 2.7 | 1.1 | 1.9 | 0.70 | 1.0 |
| Content of Inorganic oxide particles (parts) | 0 | 0 | 0.1 | 0.1 | 0.5 | 0.3 |
| Whole content of External additive (parts) | 2.4 | 2.7 | 1.2 | 2.0 | 1.2 | 1.3 |
| Percentage of a number of particles having a particle diameter of 50 nm or more in External additive (%) | 88 | 92 | 1 | 48 | 52 | 68 |
| Printing durability (sheets) | 20000 | 20000 | 7000 | 10000 | 12000 | 14000 |
| Charge stability (Q2/Q1) | 0.96 | 0.73 | 0.34 | 0.48 | 0.51 | 0.64 |
| Conveyance amount stability (M2/M1) | 1.11 | 1.07 | 1.37 | 2.04 | 1.61 | 1.50 |

6. Consideration

Hereinafter, the evaluation results of the toner will be studied with reference to Table 2.

From Table 2, the toner of Comparative example 1 is a toner containing silica d having a number average particle diameter of nm. In the toner of Comparative example 1, the percentage of the number of particles having a particle diameter of 50 nm or more in the external additive is 1%.

From Table 2, the number of sheets evaluated for printing durability of Comparative example 1 is as low as 7,000 sheets, and the charge stability (Q2/Q1) is as low as 0.34. In particular, the number of sheets evaluated for printing durability is the smallest among the toners evaluated this time. In addition, the value of charge stability (Q2/Q1) is the lowest among the toners evaluated this time. Accordingly, it can be seen that the toner of Comparative example 1 which contains spherical silica particles having a number average particle diameter of less than 70 nm, and in which the percentage of the number of particles having a particle diameter of 50 nm or more in the external additive is much less than 75% is inferior in printing durability and charge stability.

From Table 2, the toner of Comparative example 2 is a toner containing silica e having a number average particle diameter of 50 nm. In the toner of Comparative example 2, the percentage of the number of particles having a particle diameter of 50 nm or more in the external additive is 48%.

From Table 2, the number of sheets evaluated for printing durability of Comparative example 2 is as low as 10,000 sheets, the charge stability (Q2/Q1) is as low as 0.48, and the conveyance amount stability (M2/M1) is as high as 2.04. In particular, the value of conveyance amount stability (M2/M1) is the highest among the toners evaluated this time. Accordingly, it can be seen that the toner of Comparative example 2 which contains spherical silica particles having a number average particle diameter of less than 70 nm, and in which the percentage of the number of particles having a particle diameter of 50 nm or more in the external additive is less than 75% is inferior in printing durability, charge stability, and conveyance amount stability.

From Table 2, the toner of Comparative example 3 is a toner containing silica f having a number average particle diameter of 70 nm. In the toner of Comparative example 3, the percentage of the number of particles having a particle diameter of 50 nm or more in the external additive is 52%.

From Table 2, the number of sheets evaluated for printing durability of Comparative example 3 is as low as 12,000 sheets, the charge stability (Q2/Q1) is as low as 0.51, and the conveyance amount stability (M2/M1) is as high as 1.61. Accordingly, it can be seen that the toner of Comparative example 3 in which the percentage of the number of particles having a particle diameter of 50 nm or more in the external additive is less than 75% is inferior in printing durability, charge stability, and conveyance amount stability.

From Table 2, the toner of Comparative example 4 is a toner containing silica f having a number average particle diameter of 70 nm. In the toner of Comparative example 4, the percentage of the number of particles having a particle diameter of 50 nm or more in the external additive is 68%.

From Table 2, the number of sheets evaluated for printing durability of Comparative example 4 is as low as 14,000 sheets, and the charge stability (Q2/Q1) is as low as 0.64. Therefore, it can be seen that the toner of Comparative example 4 in which the percentage of the number of particles having a particle diameter of 50 nm or more in the external additive is less than 75% is inferior in printing durability and charge stability.

On the other hand, from Table 2, the toners of Example 1 to Example 9 are toners containing any one of silica a to silica c having a number average particle diameter of from 80 nm to 90 nm. In the toners of Example 1 to Example 9, the percentage of the number of particles having a particle diameter of 50 nm or more in the external additive is from 80% to 92%.

From Table 2, the number of sheets evaluated for printing durability of Example 1 to Example 9 is 20,000 sheets or more, the charge stability (Q2/Q1) falls within the range of 0.72 to 0.99, and the conveyance amount stability (M2/M1) falls within the range of 0.95 to 1.58.

Accordingly, it can be seen that the toners of Example 1 to Example 9 in which the number average particle diameter of spherical silica particles is from 70 nm to 200 nm, and the percentage of the number of particles having a particle diameter of 50 nm or more in the external additive is 75% or more are toners excellent in printing durability, charge stability, and conveyance amount stability.

The invention claimed is:

1. A positively-chargeable non-magnetic toner for developing electrostatic images, comprising colored resin particles comprising a binder resin and a colorant, and an external additive, wherein the external additive comprises spherical silica particles having a number average particle diameter of from 70 nm to 200 nm and a sphericity of from 1 to 1.3, as a first external additive, wherein inorganic oxide particles having a number average particle diameter of from 5 nm to 25 nm, as a second external additive, wherein a content of the spherical silica particles as the first external additive is from 0.5 part by mass to 4.5 parts by mass with respect to 100 parts by mass of the colored resin particles, wherein a content of the inorganic oxide particles as the second external additive is from 0.01 part by mass to 0.4 part by mass with respect to 100 parts by mass of the colored resin particles; and, wherein the external additive has a particle size distribution in which a percentage of a number of particles having a particle diameter of 50 nm or more is 75% or more, which is calculated based on a SEM image of the external additive.

2. The positively-chargeable non-magnetic toner for developing electrostatic images according to claim 1, wherein a content of the external additive is from 0.5 part by mass to 5.0 parts by mass with respect to 100 parts by mass of the colored resin particles.

3. A method for producing a positively-chargeable non-magnetic toner for developing electrostatic images, the method comprising the steps of:

producing colored resin particles comprising a binder resin and a colorant, and external addition in which an external additive is added on surfaces of the colored resin particles by mixing and stirring the colored resin particles with the external additive, wherein, in the external addition step, spherical silica particles having a number average particle diameter of from 70 nm to 200 nm and a sphericity of from 1 to 1.3, as a first external additive, wherein inorganic oxide particles having a number average particle diameter of from 5 nm to 25 nm, as a second external additive, are added on surfaces of the colored resin particles, wherein, in the external addition step, the spherical silica particles as the first external additive are used at an amount ratio of from 0.5 part by mass to 4.5 parts by mass with respect to 100 parts by mass of the colored resin particles, and wherein the inorganic oxide particles as the second external additive are used at an amount ratio of from 0.01 part by mass to 0.4 part by mass with respect to 100 parts by mass of the colored resin particles, so as that a particle size distribution of the external additive which is calculated based on a SEM image of the external additive and defined as a percentage of a number of particles having a particle diameter of 50 nm or more is brought to 75% or more.

4. The production method according to claim 3, wherein the inorganic oxide particles as the second external additive are added on the colored resin particles, and the spherical silica particles as the first external additive are further added on the colored resin particles on which the inorganic oxide particles are added.

5. The production method according to claim 3, wherein an amount of the external additive is from 0.5 part by mass to 5.0 parts by mass with respect to 100 parts by mass of the colored resin particles.

* * * * *